US007509755B2

(12) United States Patent
Avanzini

(10) Patent No.: US 7,509,755 B2
(45) Date of Patent: Mar. 31, 2009

(54) APPARATUS FOR DRYING AND MASSAGING FEET

(76) Inventor: Michele Avanzini, Via Murri, 36, Parma (IT) 43100

( * ) Notice: Subject to any disclaimer, the term of this patent is extended or adjusted under 35 U.S.C. 154(b) by 0 days.

(21) Appl. No.: 11/771,116

(22) Filed: Jun. 29, 2007

(65) Prior Publication Data

US 2008/0010851 A1 Jan. 17, 2008

(30) Foreign Application Priority Data

Jul. 14, 2006 (IT) ..... PR2006A0064

(51) Int. Cl.
*F26B 19/00* (2006.01)

(52) U.S. Cl. ..... 34/90; 34/232; 34/233; 34/235

(58) Field of Classification Search ..... 34/90, 34/104, 202, 218, 232, 233, 234, 235; 601/104; 36/3 B See application file for complete search history.

(56) References Cited

U.S. PATENT DOCUMENTS

| | | | | |
|---|---|---|---|---|
| 3,939,825 | A * | 2/1976 | Krummenacher | 601/104 |
| 4,513,735 | A * | 4/1985 | Friedson et al. | 601/15 |
| 5,438,764 | A | 8/1995 | Reppas et al. | |
| 6,189,231 | B1 | 2/2001 | Lancer | |
| 6,393,717 | B1 | 5/2002 | Santos et al. | |
| 6,755,398 | B1 * | 6/2004 | Wong | 261/81 |
| 6,839,982 | B1 * | 1/2005 | Hoover | 34/90 |
| 2003/0106240 | A1 * | 6/2003 | Wang et al. | 36/3 B |
| 2007/0078361 | A1 * | 4/2007 | Wong et al. | 601/104 |

* cited by examiner

*Primary Examiner*—Jiping Lu
(74) *Attorney, Agent, or Firm*—Pearne & Gordon LLP

(57) ABSTRACT

An apparatus for drying and massaging feet, comprising a plate (2) whereon the feet are set, defining a plurality of holes (3) through which air escapes towards the feet, at a pressure of at least 0.5 bar, such as to produce not only the drying but also a massaging effect on the feet. The holes (3) are distributed at greater concentration in the regions where the toes and the front part of the feet bear. The plate (2) comprises a plurality of interchangeable templates (8) to adapt the apparatus to different foot sizes.

5 Claims, 7 Drawing Sheets

APPARATUS FOR DRYING AND MASSAGING FEET

The present invention relates to an apparatus for drying and massaging feet, of the type comprising a base whereon the feet can be set, defining a plurality of holes, and means to make air escape from said holes towards the feet.

A fundamental rule of hygiene is not only to wash one's feet daily with lukewarm water and neutral soap, but also thoroughly to dry one's feet gently between the toes, without rubbing, to remove any moisture. However, when the toes are superposed or retracted, as a result of pathologies, and spreading them is difficult, a normal towel cannot be passed between the toes.

Failure to dry properly may lead to several foot pathologies, such as intertoe tinea-pedis, which finds a favourable medium in the constant moisture of the foot.

Particular care must be reserved to the feet of diabetes patients, who must be dry yet more carefully, especially the toe clefts, to avoid skin maceration which could cause ulcers and infections that can degenerate into necrosis.

In this context, air drying is indicated, not just as a cure but also for prevention purposes.

Known devices for drying feet are often rather complex and costly because they also provide for applying powders or liquids with anti-bacterial or anti-fungal effect.

Some of these devices are described in U.S. Pat. Nos. 5,438,764, 6,189,231, 6,393,717.

However, these devices exhibit numerous problems.

The holes through which foot-drying air escapes are distributed uniformly, and therefore they do not allow to concentrate the action in the intertoe region, which, as is well known, is the most problematic one to treat.

Moreover, the holed surface whereon the foot bears is flat and hence when the foot bears on the holes, the action of the air is nearly nil, because its escape from the holes is prevented as a result of the weight of the foot that obstructs it. Conversely, air does instead escape from the holes that remain outside the perimeter of the sole of the foot, but the drying action through those holes is substantially nil because it is not directed towards the foot but simply towards the surrounding environment.

Essentially, these devices are mostly ineffective and, as far as is known, they have not at all been successful on the market.

An object of the present invention is to eliminate the aforesaid problems, making available an apparatus for drying feet that is effective and that can, at the same time, also exert a massaging action on the feet.

An additional object is to make the apparatus suitable for the different dimensions of users' feet, constructing it in simple, economical fashion. Said objects are fully achieved by the apparatus of the present invention, and in particular in that the air escapes the holes at a pressure of at least 0.5 bar (and preferably 0.5-0.7 bar), such as to produce not only the drying but also a massaging effect on the feet.

Preferably, the holes are distributed at greater concentration in the regions where the toes and the front part of the feet bear.

The base preferably comprises a plurality of interchangeable templates to adapt the apparatus to different foot sizes, avoiding the presence of holes that would remain unused because they would be external to the profile of the user's feet.

This and other characteristics shall become more readily apparent from the following description of some preferred embodiments, one of which is illustrated purely by way of non limiting example in the accompanying drawing tables in which.

Figure 1:
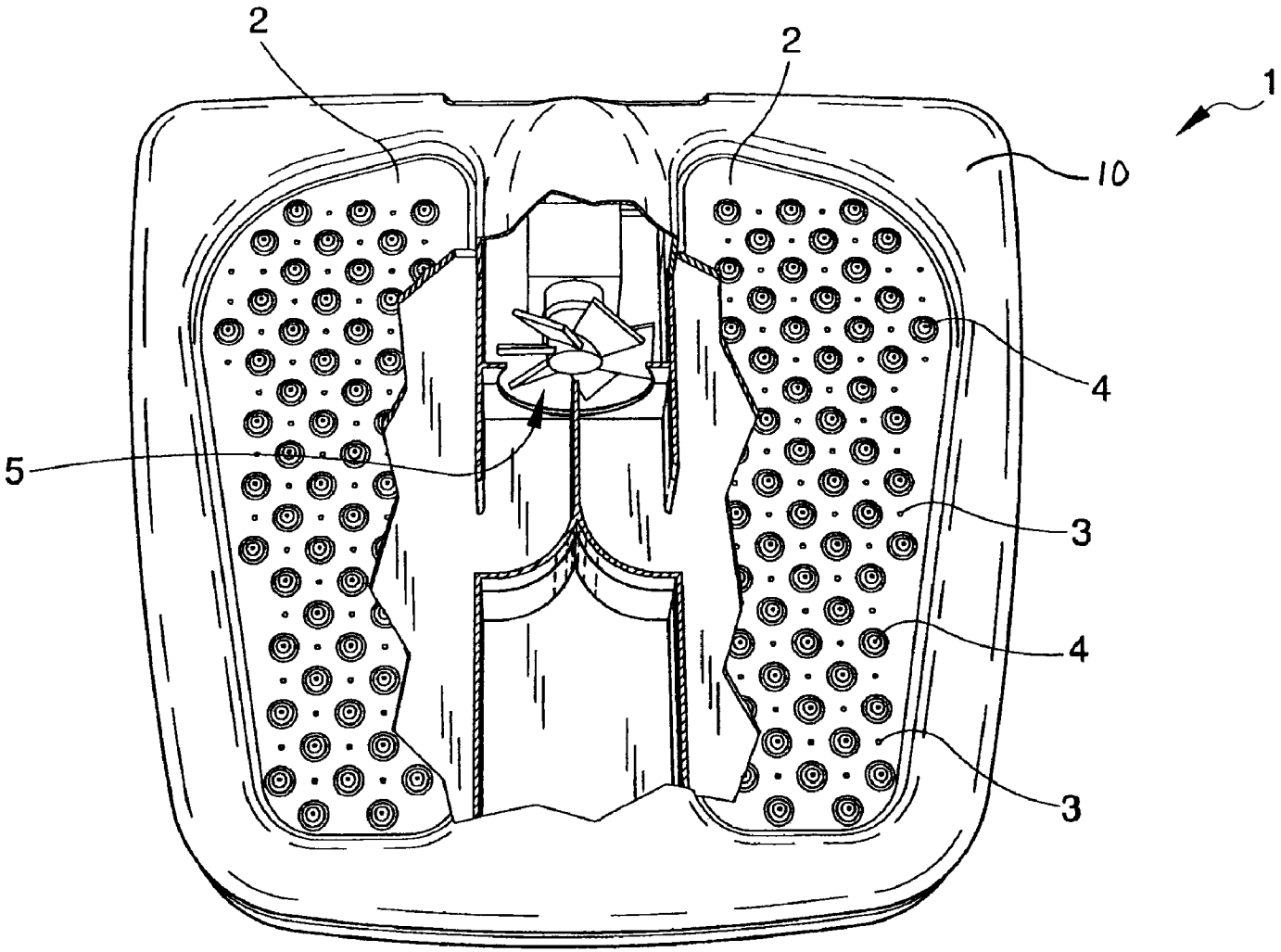
FIG. 1 shows the apparatus in a partially sectioned view.
Figure 2:
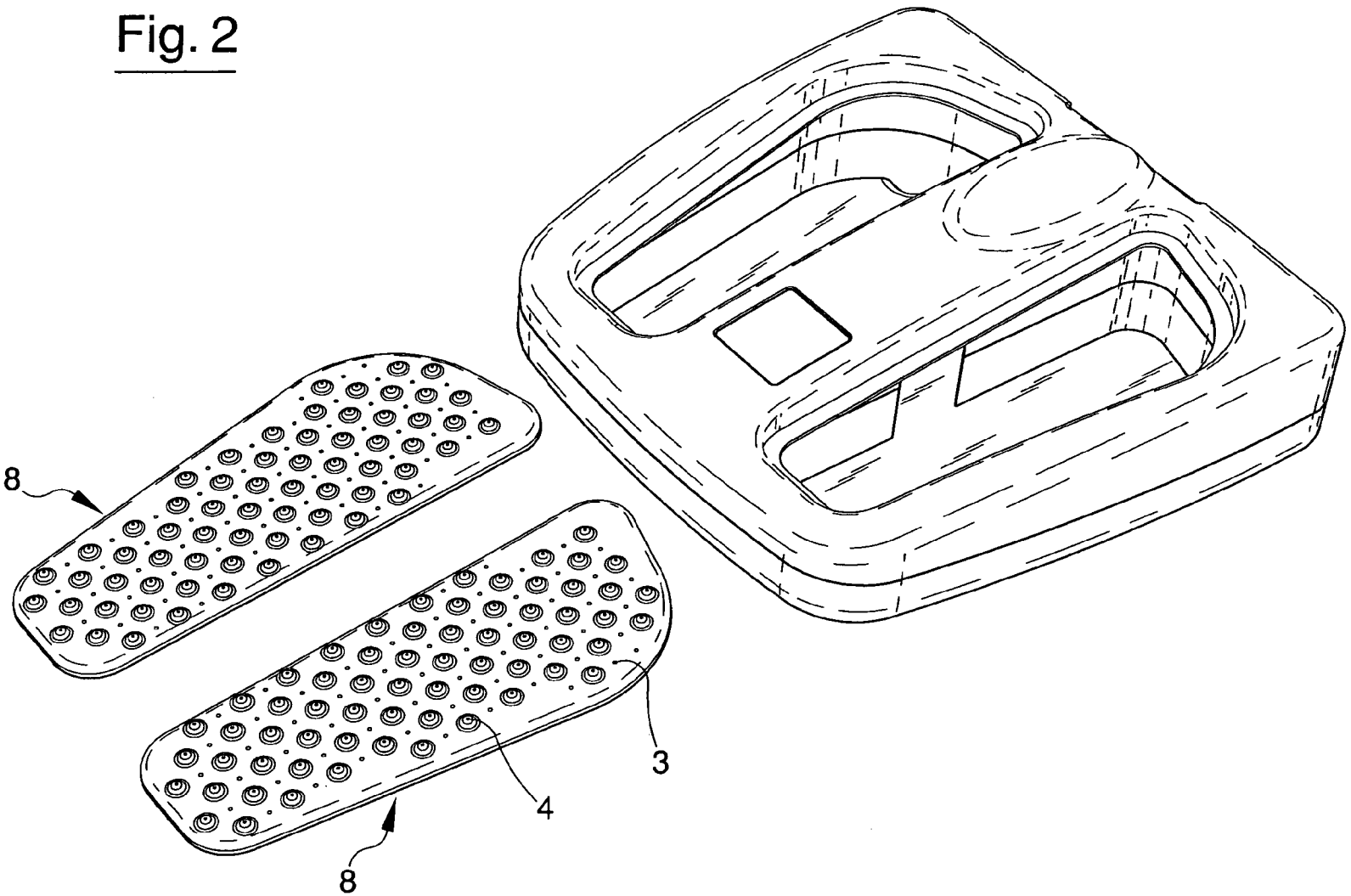
FIG. 2 shows separately the templates and the apparatus.
Figure 3:
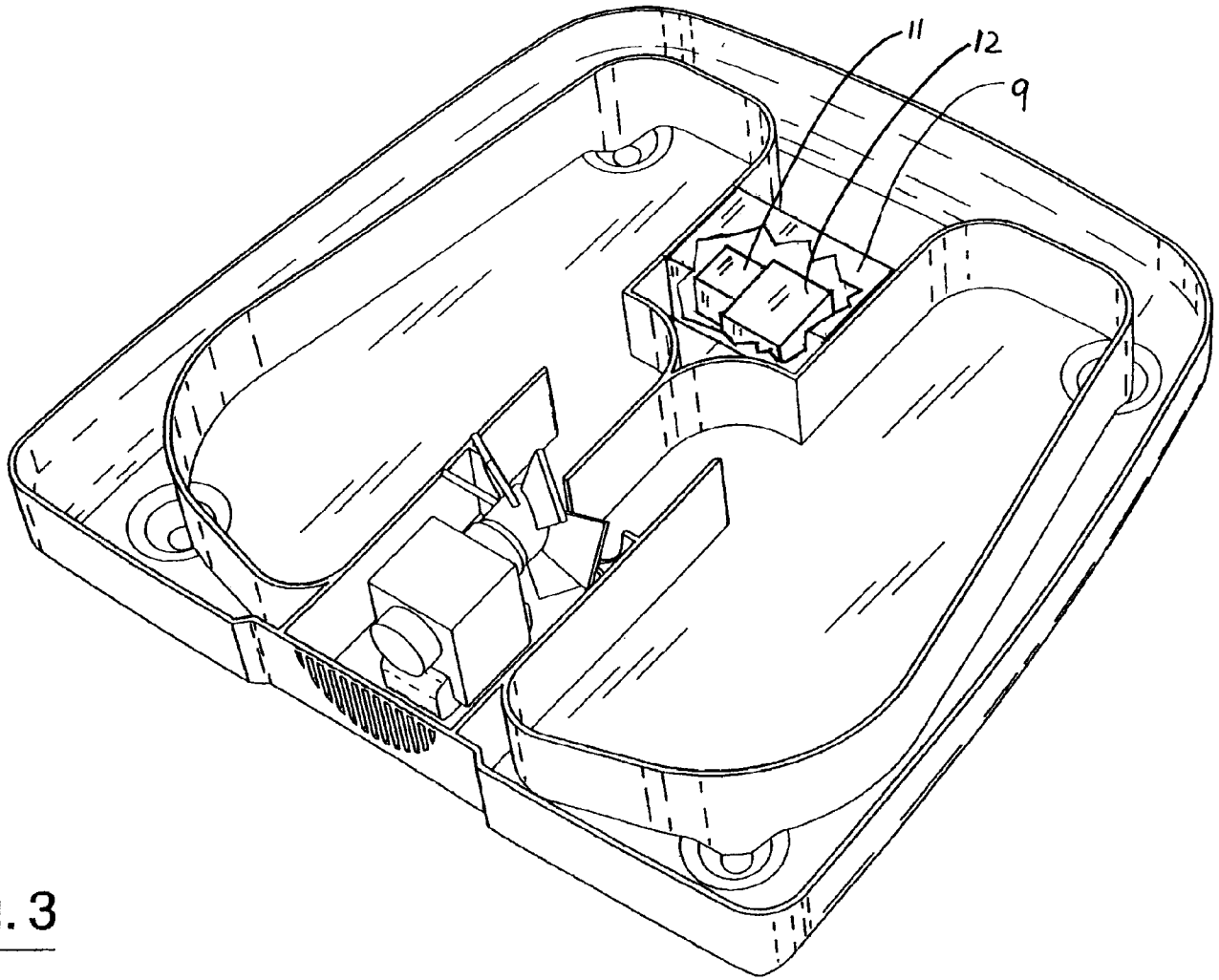
FIGS. 3 to 5 show the internal details of the apparatus.
Figure 4:
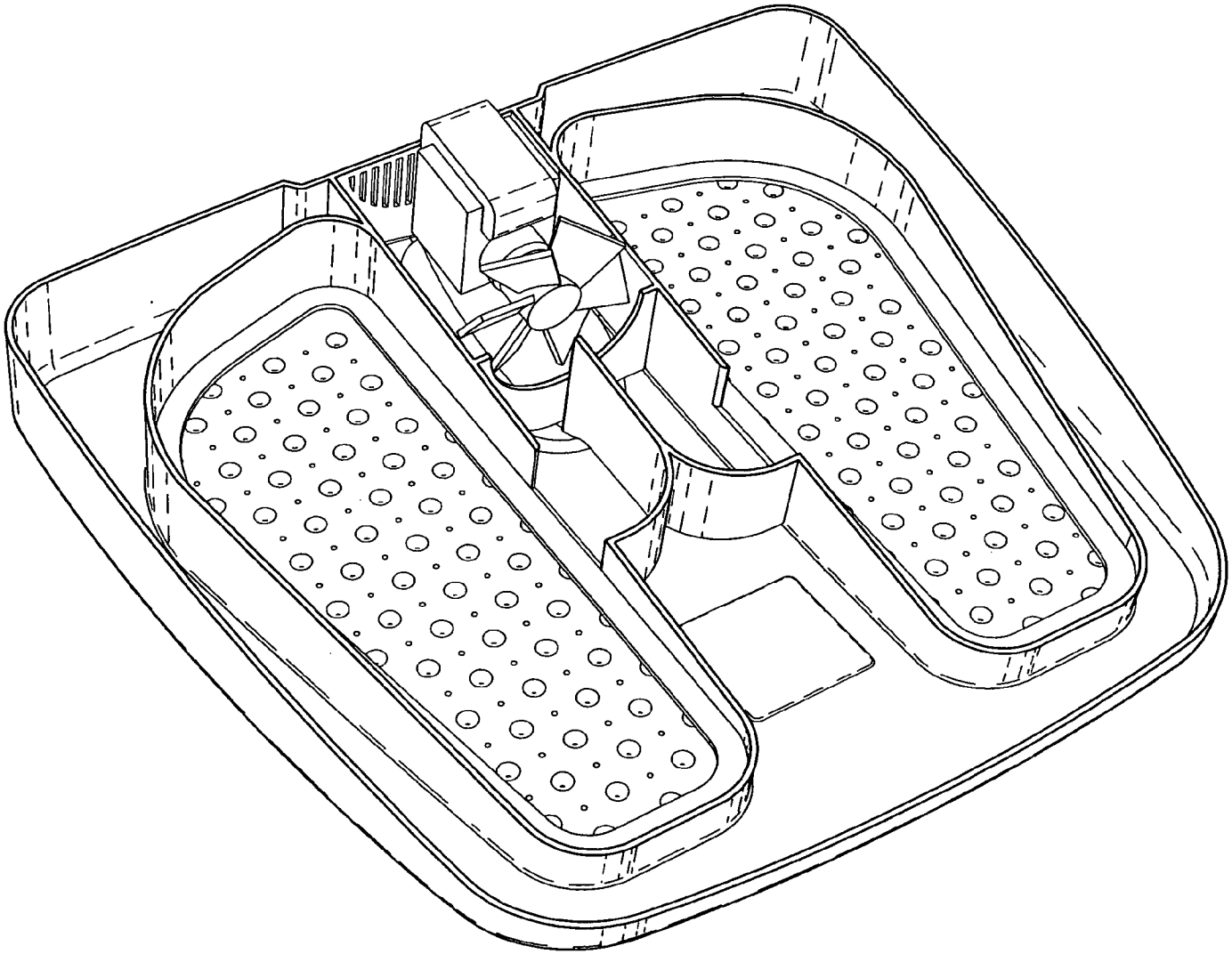
Figure 5:
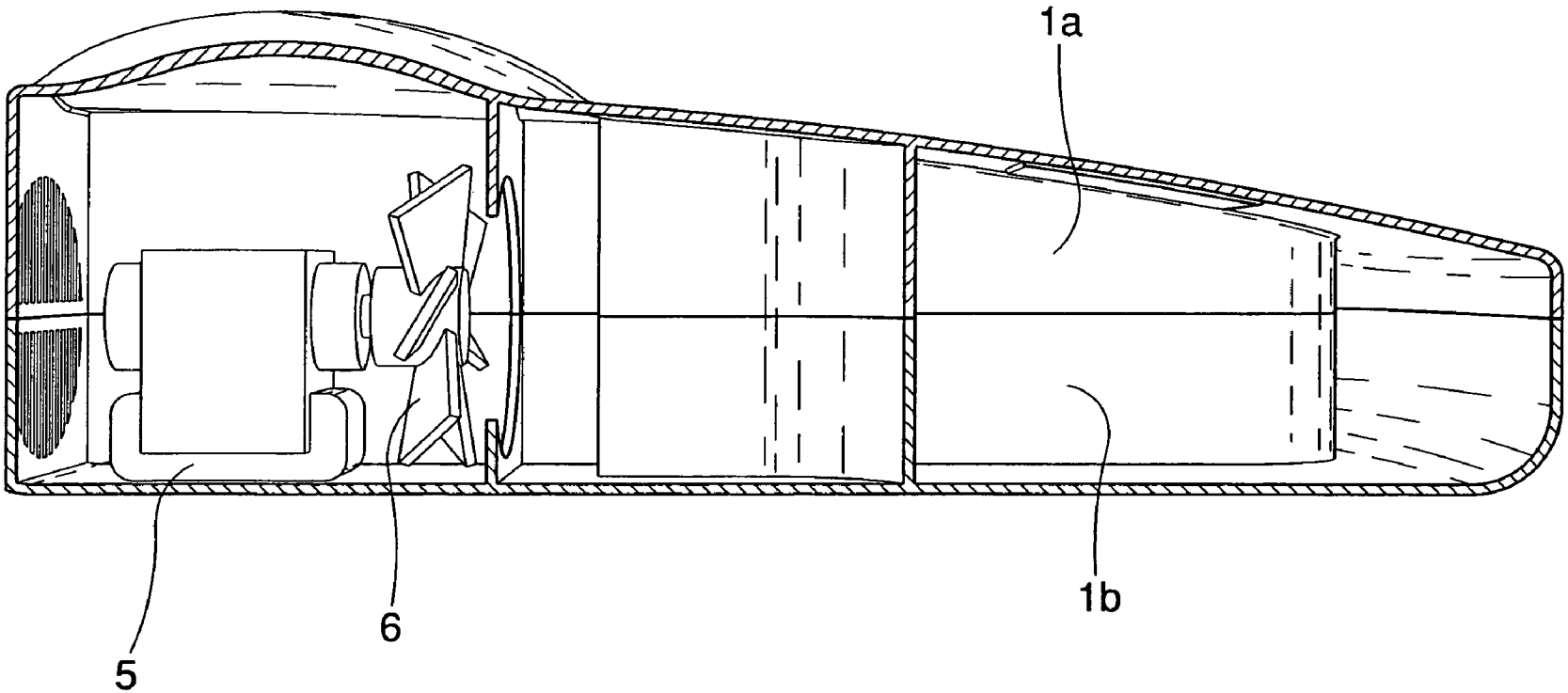
Figure 6:
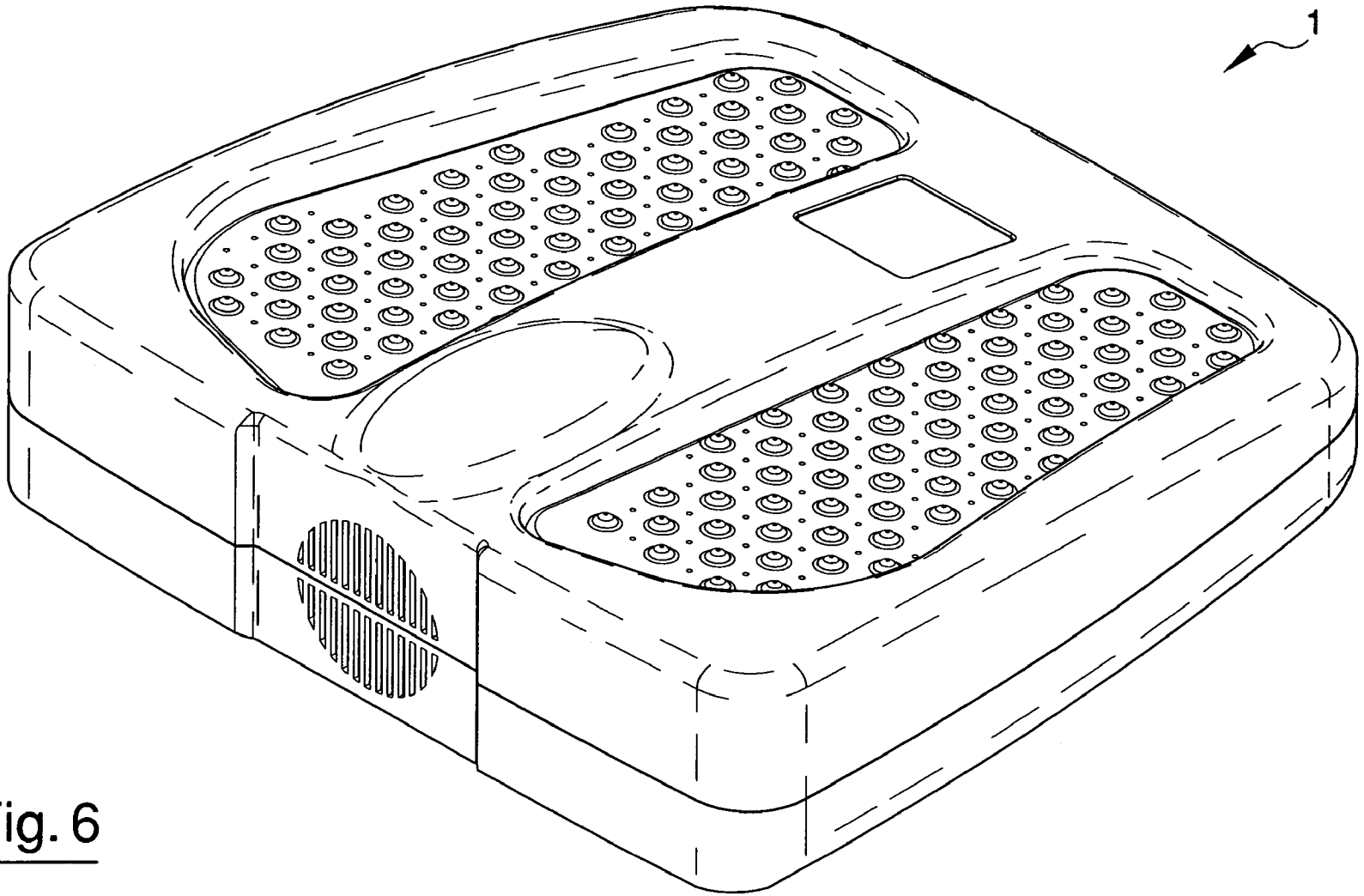
FIG. 6 shows a perspective view of the apparatus.
Figure 7:
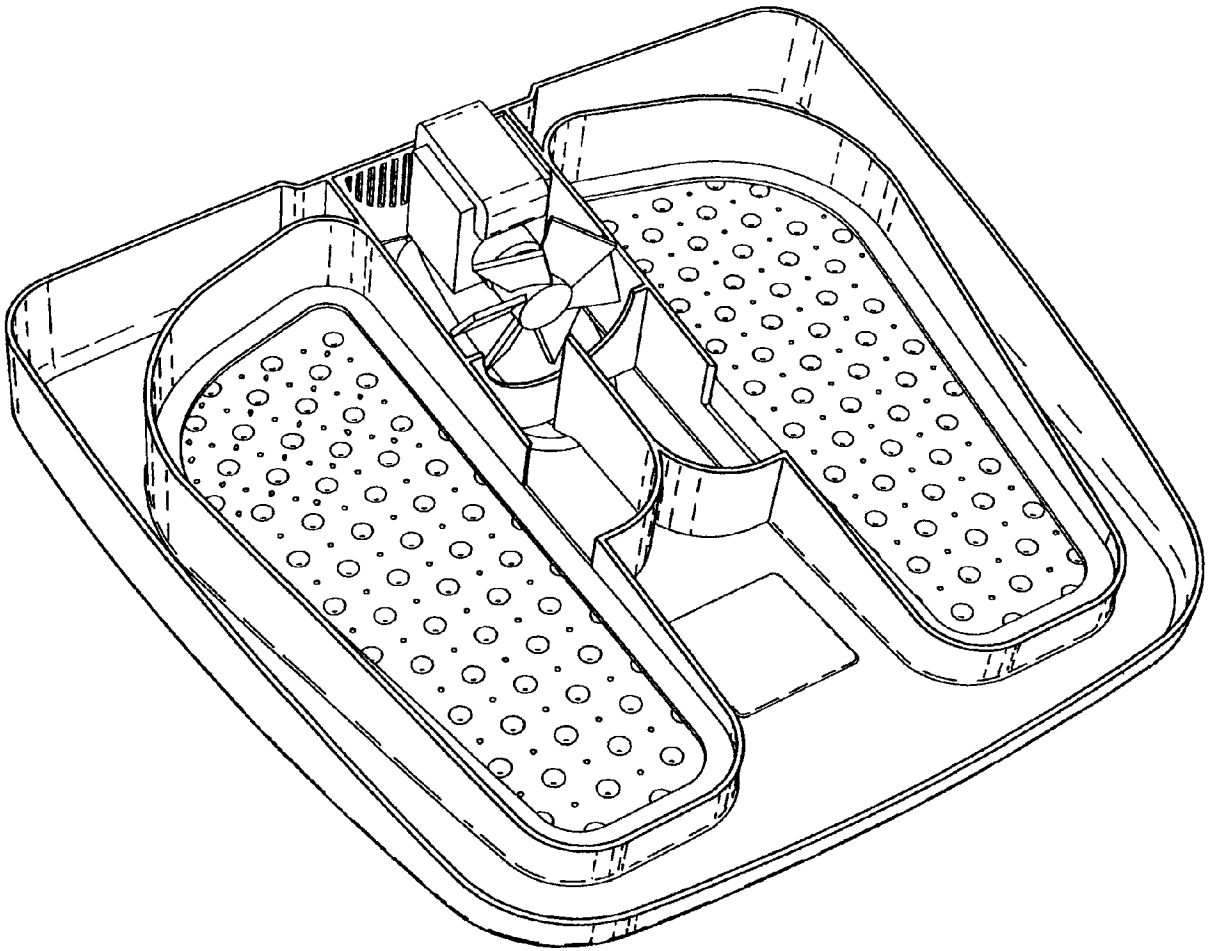
FIG. 7 shows, on the left side, a template having air holes distributed at greater concentration in the region where the toes and the front cart of the foot bear.

With reference to the Figures, the number 1 indicates, in its entirety, an apparatus for drying and massaging feet.

The apparatus, for home use or for use in medical and physiotherapeutic centre or in gyms, is normally placed on the floor and it used by a sitting user who rests his/her feet on the apparatus and more specifically on an upper plate 2 of the apparatus in which are defined holes 3 together with projections or protuberances 4.

The apparatus comprises a tangential fan 5 actuated by a motorisation 6 powered by the mains or by a rechargeable battery associated to the apparatus and such as to allow a fully safe utilisation of the apparatus. Through an electronic speed variator, not shown, it is possible to vary the rate of rotation of the fan to vary the flow of air that is sent towards the holes and hence the pressure of the air that escapes from the holes 3. One or more resistors (not shown) enable to heat said flow of air to a temperature ranging between 20° C. and 35° C. and adjustable and settable through a thermostat, also not shown.

The air can be emitted from the holes at ambient temperature or heated up to about 35° C.

The holes 3, preferably circular, have a diameter of 2-3 mm so that the pressure of the air that escapes from them is about 0.5-0.7 bar, such as to produce not only the drying but also a massaging effect on the feet.

The holes 3 are distributed at greater concentration in the regions where the toes and the front part of the feet bear, and in fact at least half of the holes are in the toe region.

However in the drawings a less efficient embodiment is shown wherein the holes 3 are uniformly distributed.

The user rests his/her feet on the protuberances 4 in such a way that between the feet and the holes there is a thin gap in which the air that escapes from the holes 3 escapes.

The holes can have cylindrical or conical shape (with the lower base towards the exit or towards the entrance of the air) or another suitable shape.

To prevent air from being needlessly dispersed and to cause it instead to impact the user's feet, interchangeable templates 8 are used.

Preferably, three templates are used, corresponding to the Italian shoe sizes 35-38, 39-42 and 43-46.

The templates are preferably sheets of cardboard or plastic material in which are drilled the holes 3 distributed on foot shapes.

The templates 8 are set in air-tight fashion into openings where are located the plate 2, through sealing gaskets.

For example, if a user has such feet as to wear size 41 shoes, the 39-42 template is applied to the base 10 in such a way that the emission of air involves only a limited region of the template, approximately matching the size of the foot to be dried, and that there are no holes outside the profiles of the user's feet, concentrating the emission of air only in the region of interest.

The total number of holes left active by the templates is between 30 and 50 (i.e. 15-25 for each foot), depending on the effective dimensions of the templates, that is depending on the size of the zone of the templates wherein the holes are located.

Means 9 are provided to produce the vibration of the base 10, comprising a gearmotor 11 that actuates a movable plate 12 provided with eccentric mass.

Said means 9 can be activated without activating the air, in such a way as to produce only a vibrating massage of the feet, or the drying-massaging of the feet with air can be activated excluding the vibrating means, or both the drying and massaging air and the massaging vibration can be activated.

The activation and deactivation of the apparatus can take place by pressure (by means of a pressure sensor or load cell that senses the pressure exerted by the feet on the base), or by using a presence sensor of photocell, or by means of a push-button positioned externally on the apparatus, or by means of a remote control.

Through the remote control it is also possible to control the regulation of the speed of the fan and of the temperature of the air that escapes from the holes 3.

The apparatus 1 comprises two superimposed halves 1*a* and 1*b*, as shown in the figures designed to create a particular internal circuit for the air.

The invention claimed is:

1. An apparatus for drying and massaging a pair of feet, said apparatus comprising a base having a pair of openings, said pair of openings containing a pair of first templates which have air holes arranged to correspond to a first foot size, each opening being substantially the size of the template it contains, said apparatus further comprising means to drive dry ambient air through said air holes at a pressure of at least 0.5 bar towards the feet to produce a drying and a massaging effect on the feet, the apparatus further comprising a pair of second templates which have air holes arranged to correspond to a second foot size different from said first foot size, the pair of second templates being interchangeable with the pair of first templates, each template having a plurality of fixed projections where the foot bears in order to enable a diffusion of the driven air in a gap between the template and the foot, the air holes of each template being distributed at greater concentration in the region where the toes and the front part of the foot bear, the apparatus further comprising means to produce a vibration of the base, the vibration means comprising a gearmotor that actuates a movable plate provided with eccentric mass.

2. An apparatus as claimed in claim 1, wherein the temperature of the air that escapes from the holes is between 20° C. and 35° C., and the apparatus comprises means for regulating said temperature.

3. An apparatus as claimed in claim 1, wherein the apparatus comprises means for regulating the velocity and pressure of the air.

4. An apparatus as claimed in claim 1, wherein the total number of holes left active by the templates is between 30 and 50.

5. An apparatus as claimed in claim 1, wherein the holes have a diameter of 2-3 mm.

* * * * *